United States Patent [19]

Oberan

[11] Patent Number: 4,528,548

[45] Date of Patent: Jul. 9, 1985

[54] VALIDITY SIGNAL APPARATUS FOR MONITORING A LINE BOUNDARY

[75] Inventor: Stephen L. Oberan, Glendale, Ariz.

[73] Assignee: Daniel R. Oberan, Scottsdale, Ariz.

[21] Appl. No.: 426,989

[22] Filed: Sep. 29, 1982

[51] Int. Cl.[3] ..... G08B 23/00

[52] U.S. Cl. ..... 340/323 R; 273/29 R; 273/411

[58] Field of Search ..... 340/323 R, 556; 273/29 R, 31, 50, 411; 250/221

[56] References Cited

U.S. PATENT DOCUMENTS

| | | | |
|---|---|---|---|
| 2,113,899 | 4/1938 | Oram | 340/323 |
| 2,473,893 | 6/1949 | Lyle | 340/323 |
| 2,653,309 | 9/1953 | Hausz | 340/556 |
| 3,810,148 | 5/1974 | Karsten | 273/50 |
| 3,982,759 | 9/1976 | Grant | 340/323 R |
| 4,004,805 | 1/1977 | Chen | 340/323 R |
| 4,224,608 | 9/1980 | Lederer | 250/221 |
| 4,432,058 | 2/1984 | Supran | 273/29 R |

FOREIGN PATENT DOCUMENTS

| | | | |
|---|---|---|---|
| 7720 | 2/1980 | European Pat. Off. | 273/31 |
| 2025241 | 1/1980 | United Kingdom | 273/29 R |

*Primary Examiner*—James J. Groody
*Assistant Examiner*—Michael F. Heim
*Attorney, Agent, or Firm*—H. Gordon Shields

[57] ABSTRACT

Apparatus for determining the validity of a kill shot in racketball or handball, or the like, or of an "out" ball in tennis includes light beam arrays and the interruption of one or more light beams and the timing involved in the interruption is used to provide an appropriate signal.

9 Claims, 13 Drawing Figures

VALIDITY SIGNAL APPARATUS FOR MONITORING A LINE BOUNDARY

BACKGROUND OF THE INVENTION

1. Field of the Invention

This invention relates to apparatus for monitoring a line boundary for determining the validity of a particular "shot" of a ball, and, more particularly, to apparatus for determining the validity of a kill shot in racketball or handball or the like.

2. Description of the Prior Art

U.S. Pat. No. 3,810,148 discloses indicator apparatus for detecting and indicating the presence of an object, such as a ball, on a line or a boundary, such as a boundary line of a tennis court. A pulsed beam of light is transmitted along one side of a line or boundary being monitored. The beam of light is sensed by a receiver. An alarm detects interruptions of a pulsed beam. A second pulsed beam of light is sent along the path adjacent to, and on the other side of, the boundary, and parallel to the first beam of light. Both beams are sensed, and an alarm is energized if either or both of the beams is interrupted. One of the beams may be stylized as the "in" beam and the other beam as the "out" beam. Thus, if the "in" beam is interrupted before the "out" beam, by a tennis ball, the particular shot is a good or valid shot. However, if the "out" beam is interrupted without a corresponding interruption of the "in" beam, then the shot is a bad shot.

In the sport of bowling, light beams have been used to detect the intrusion of a bowler's foot across the flow line. Generally, one or more beams of light are used, with the beams of light being parallel to each other and disposed across an alley and thus perpendicular to the movement of the bowler as he approaches the foul line in the delivery or rolling of a ball. Such apparatus are shown in U.S. Pat. Nos. 2,455,909, 2,650,095, 2,683,602, 3,170,689, and 3,369,810.

The patents discussed in the preceding paragraphs are generally concerned with the interruption of one or more beams of light which are generally parallel to each other and aligned so as to detect the movement of a ball or a foot in a single direction or plane. However, in a game such as handball or racketball, where a front wall, two side walls, and a floor are all involved in playing, the sequential contact of a ball with the side walls, the front wall, and the floor is of primary importance in determining whether a kill shot is valid or invalid. Kill shot, by definition, is a valid shot that strikes the juncture of the front wall and floor simultaneously. Heretofore, such determination has been made on the basis only of visual sightings. Obviously, when only visual sightings are used, there may be differences of opinion as to whether a shot was a good or valid shot or whether it was an invalid shot. For example, if the ball contacts the floor before contacting the front wall, then the shot is invalid and no good. On the other hand, if the shot contacts the front wall before contacting the floor, then the shot is good.

The apparatus of the present invention includes elements for determining the sequence of a ball in contacting the front wall and the floor and accordingly determines the validity or invalidity of a particular shot during a game. An audible signal or a visual signal, or both, may accompany an invalid shot so as to alert the players and officials, if any, about the invalid shot.

SUMMARY OF THE INVENTION

The invention described and claimed herein comprises light means disposed adjacent to a boundary being monitored. The timed interruption of a light beam is used to determine whether a ball is in or out of a playing area.

Among the objects of the present invention are the following:

To provide new and useful apparatus for determining the validity of a particular shot in a sport involving a moving ball;

To provide new and useful apparatus for determining the validity of a kill shot in a racketball, handball, or similar game;

To provide new and useful apparatus for determining the sequence of an object rebounding from one or more walls;

To provide new and useful apparatus for determining when a ball lands outside and adjacent to a predetermined boundary line;

To provide new and useful apparatus for determining the sequence in which a plurality of light beams is broken; and To provide new and useful apparatus for making a determination between a ball intrusion or another type of intrusion.

BRIEF QESCRIPTION OF THE DRAWING

Figure 3A:
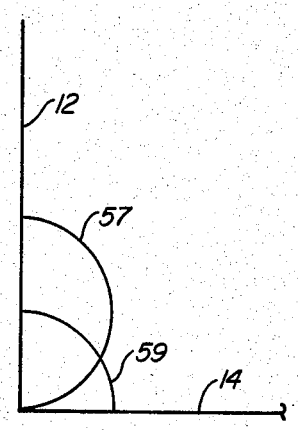
Figure 3B:
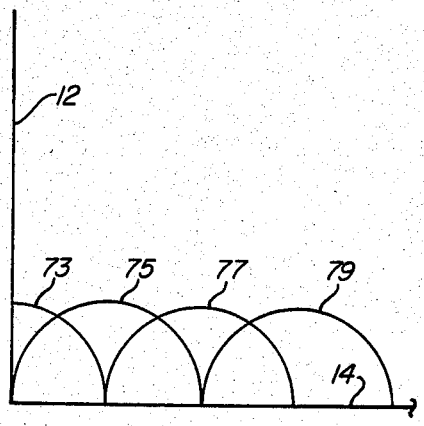
Figure 3C:
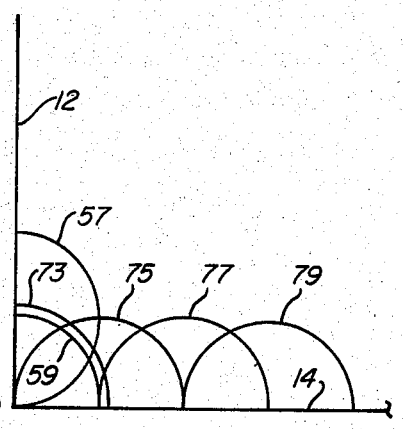

FIGS. 3A, 3B, and 3C are schematic representations of overlapping light patterns for the front wall, the floor, and the combined front wall and floor, respectively.

Figure 4:
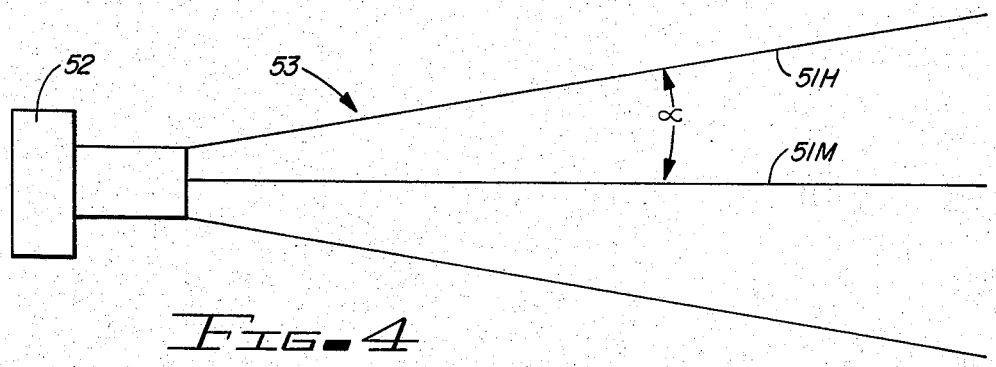

FIG. 4 is a schematic representation of a light source and the pattern of its light.

Figure 5:
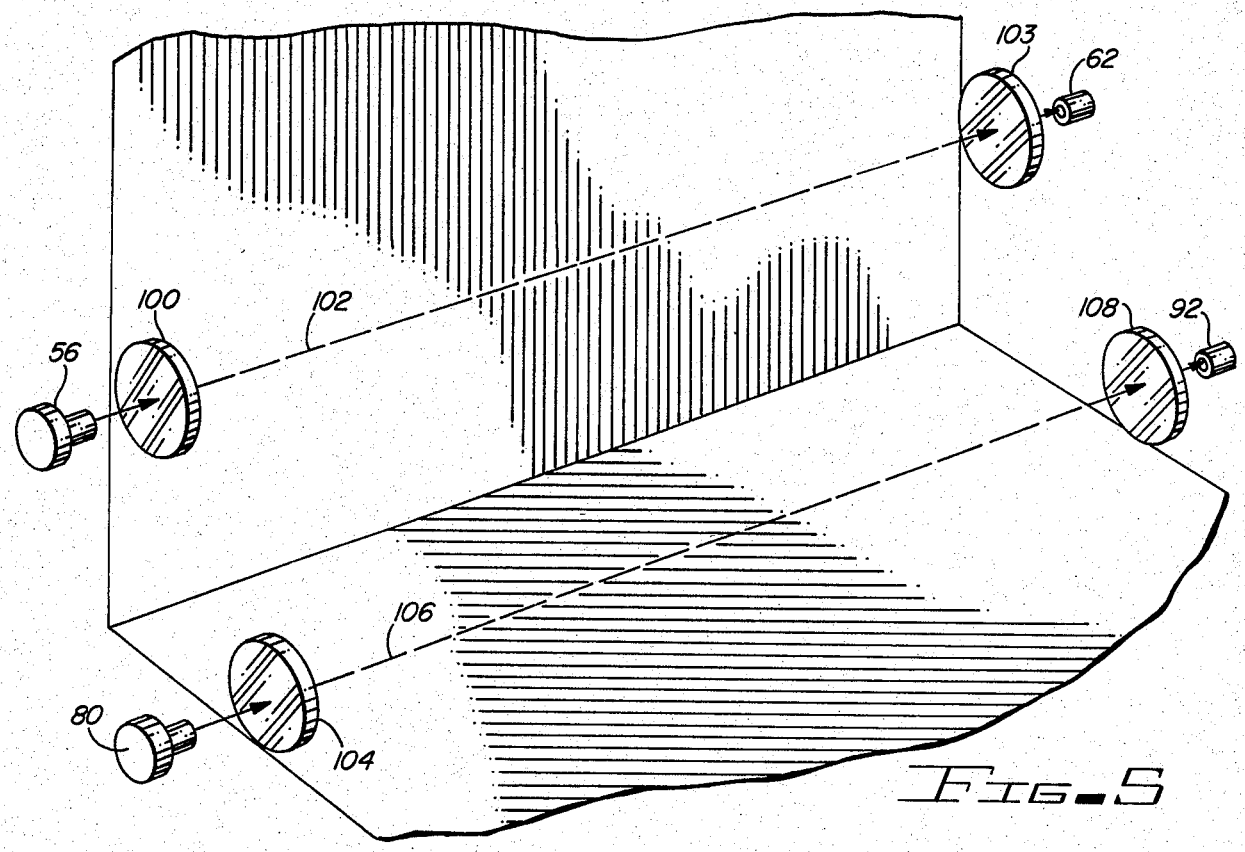
Figure 5A:
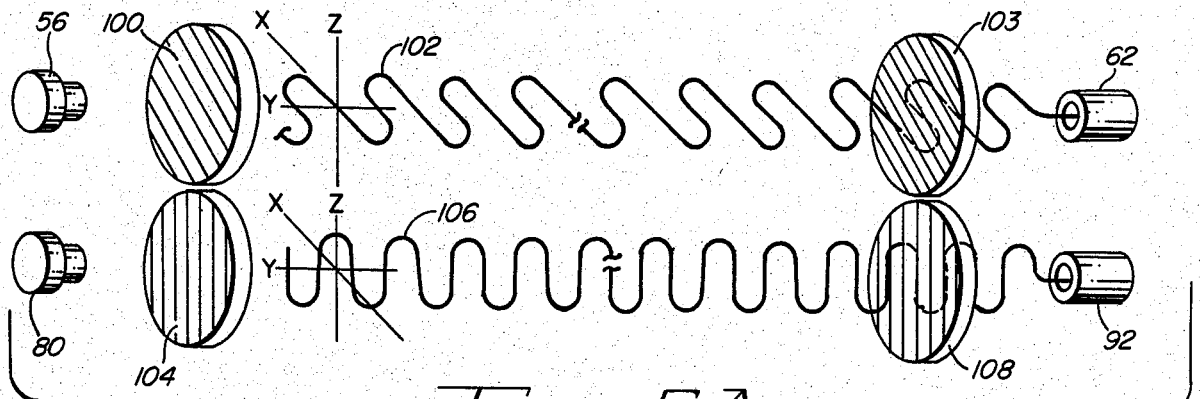

FIG. 5 is a schematic representation of an alternative light source and receptor system.

Figure 6:
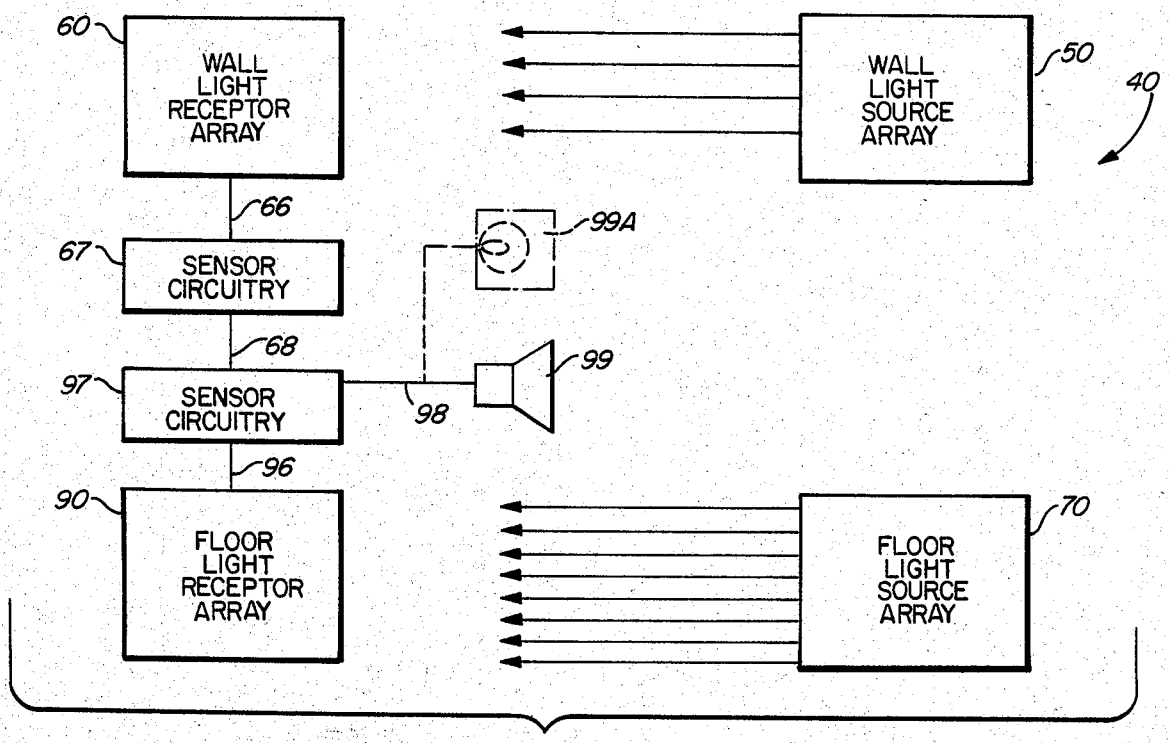

FIG. 6 is a block diagram of the apparatus of the present invention.

Figure 7:
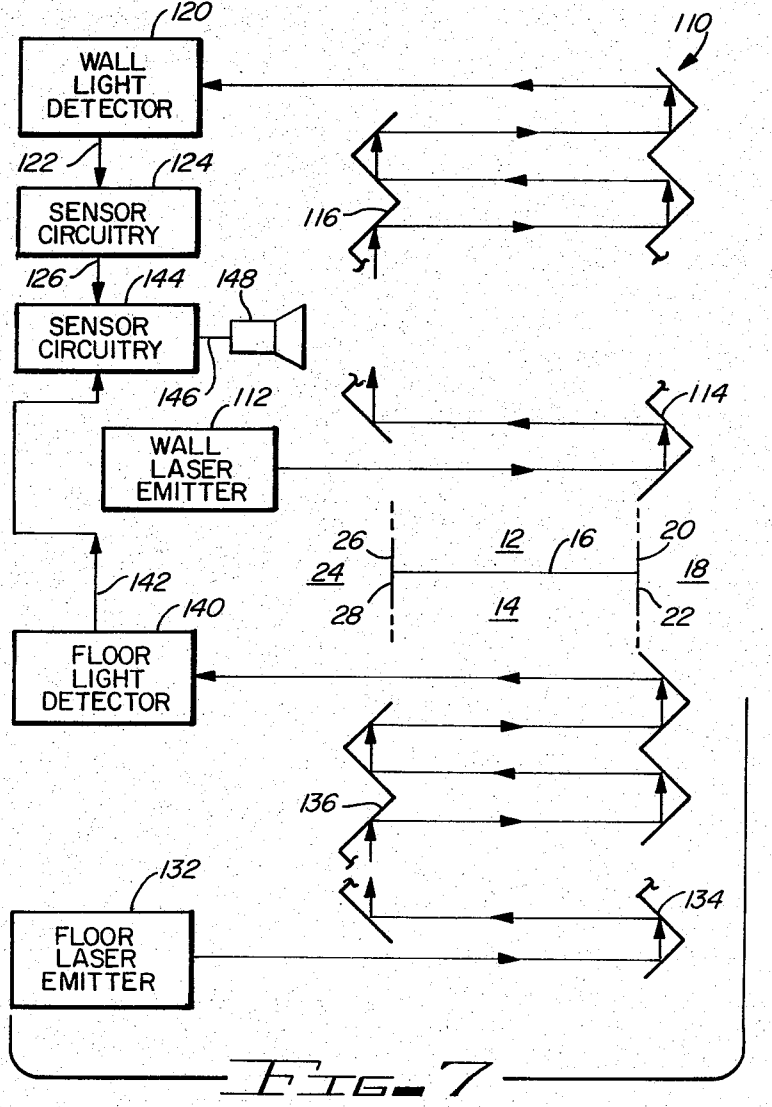

FIG. 7 is a schematic diagram of an alternative embodiment of the apparatus of the present invention.

Figure 8:
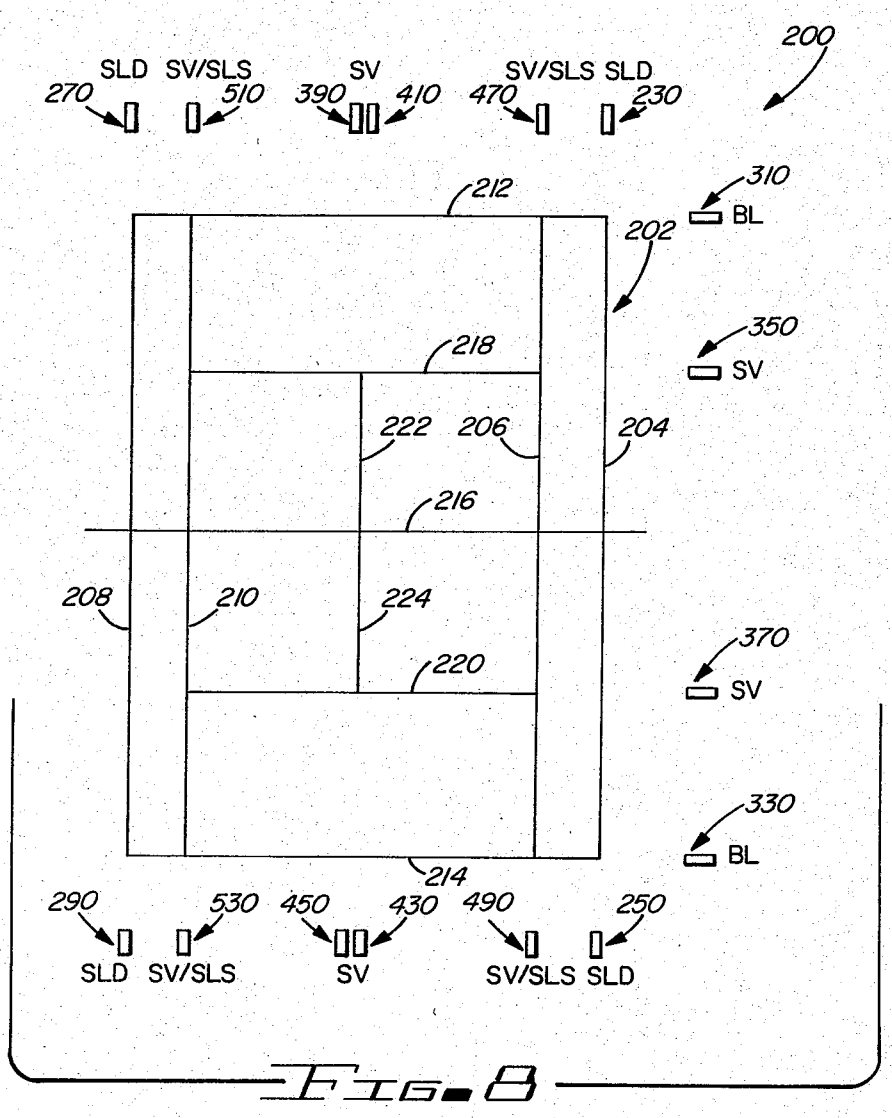

FIG. 8 is a diagram of a tennis court showing elements of the present invention associated therewith.

Figure 9:
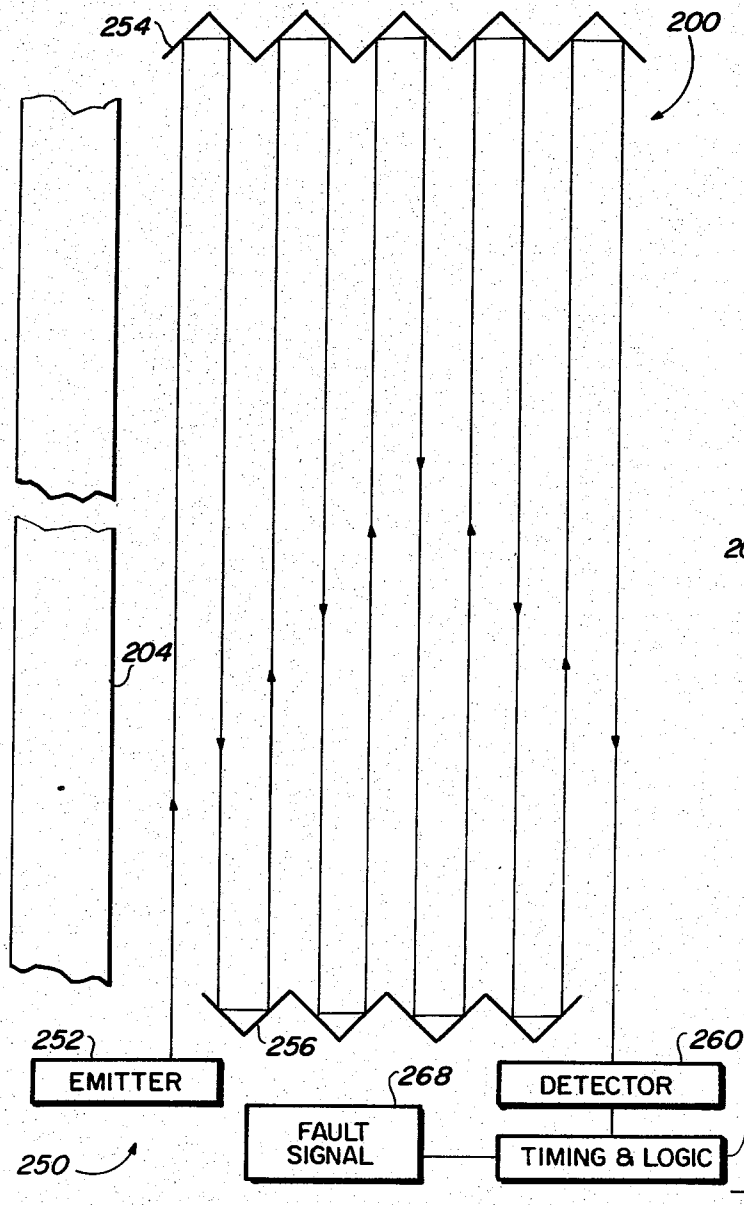

FIG. 9 is an enlarged schematic representation of a portion of FIG. 8 and of the associated elements.

Figure 10:
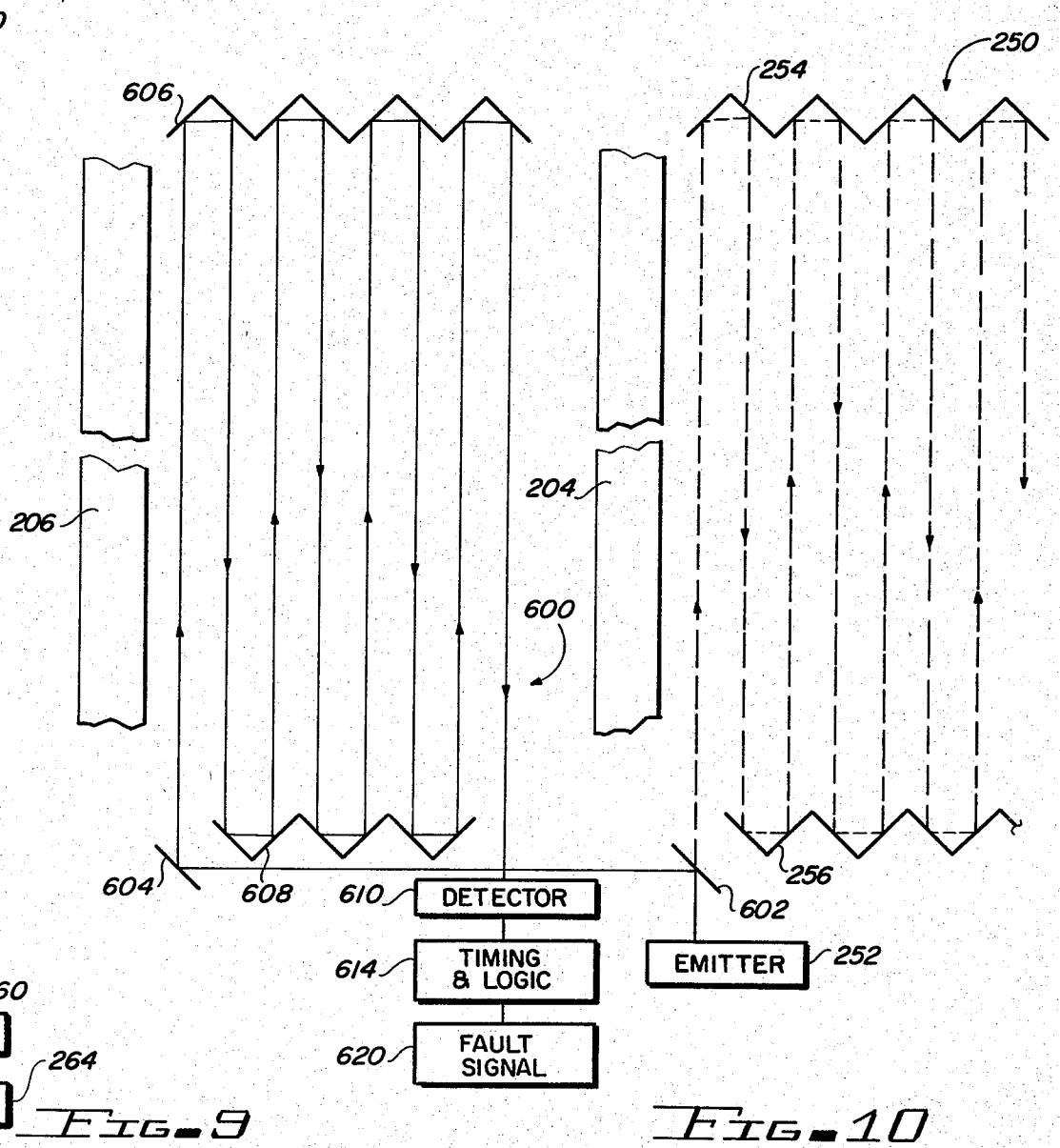

FIG. 10 is an enlarged schematic representation of a portion of FIG. 8, including that shown in FIG. 9, illustrating other associated elements.

DESCRIPTION OF THE PREFERRED EMBODIMENT

Figure 1:
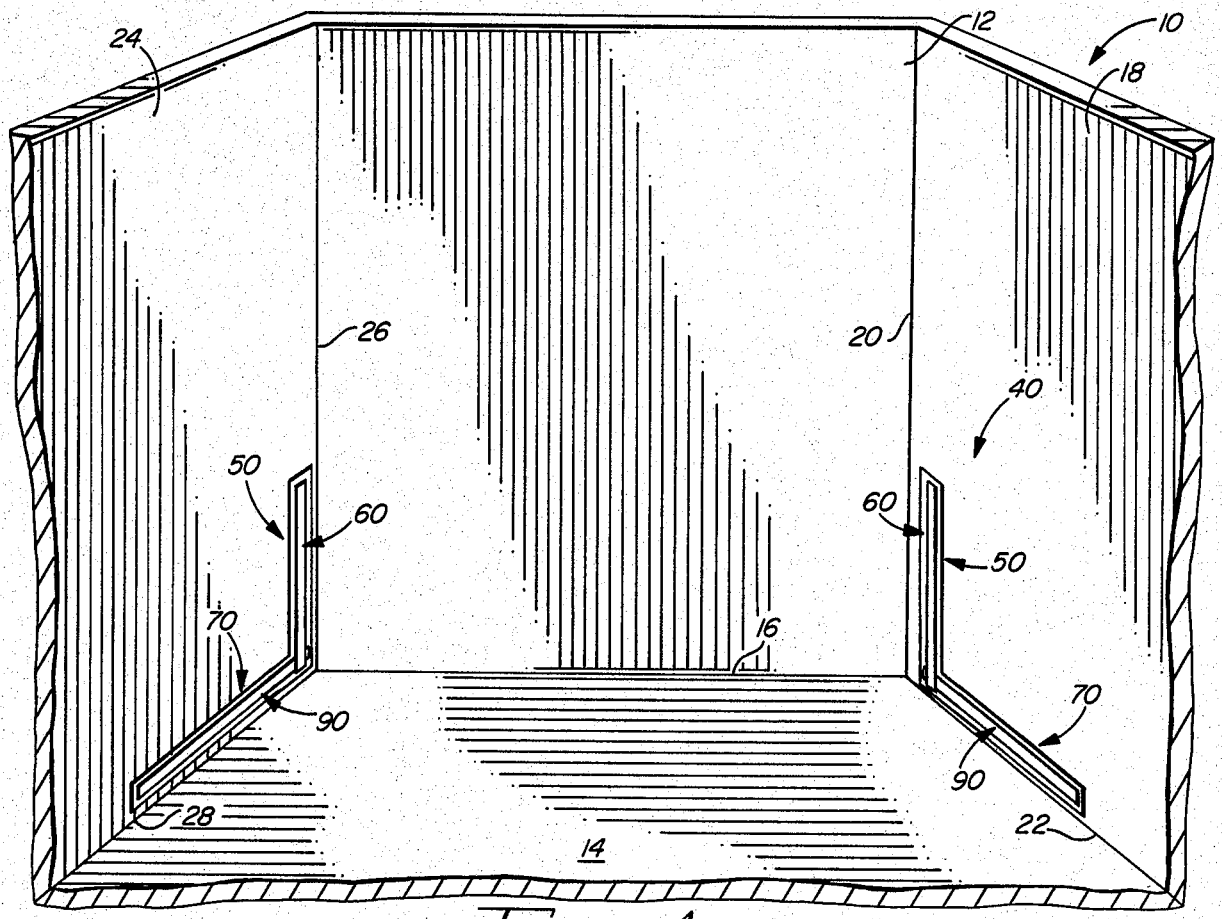
FIG. 1 is a perspective view of a racketball (handball) court with the apparatus of the present invention installed therein.

FIG. 1 is a perspective view of a handball/racketball court 10, taken generally from the rear of the court, and looking toward a front wall 12, a floor 14, and a pair of side walls 18 and 24. The front wall 12 and the floor 14 come together at a juncture 16. The juncture 16 is of paramount importance in handball and racketball because the major issue with respect to points, as pertaining to so-called kill shots, and other close shots, is whether or not a ball hits the front wall 12 before it hits the floor 14. In most cases, it is relatively easily determined whether a ball hits the front wall before it hits the floor, or vice versa. However, with kill shots, the ball is generally aimed for the front wall 12 just above the wall-floor juncture 16. Accordingly, it is more difficult to tell whether the ball hits the front wall before it hits the floor, or vice versa. In a similar manner, a ball may hit one of the side walls 18 or 24, in the area of the juncture 16, and then ricochet to either the front wall 12 or to the floor 14. If the ball hits the floor 14 after ricocheting from a side wall and before it hits the front wall 12, then the shot is not valid. If, however, the ball hits the front wall 12 after ricocheting off either side wall, then the shot is a good shot. For determining the validity of such shots, both kill shots directed at the front wall 12, and bank shots directed toward a side wall and designed to ricochet off the side wall and onto the front wall 12, the apparatus of the present invention is installed.

A wall juncture 20 is defined at the inside corner of the front wall 12 and the side wall 18. Similarly, a wall juncture 26 is defined at the inside corner of the front wall 12 and the side wall 24. A juncture 22 is defined between the side wall 18 and the floor 14, and a juncture 28 is defined between the side wall 24 and the floor 14. Validity signal apparatus 40 is disposed on the side walls 18 and 24 adjacent to the junctures 20, 22, and 26, 28. Portions of the validity signal apparatus 40 extend upwardly along the wall 18 and along the juncture 20 from the juncture 16 and along the wall 18 aligned with the juncture 22 and outwardly from the juncture 16. On the opposite side wall 24, corresponding portions of the validity signal apparatus 40 extend in a similar manner. That is, they extend upwardly from the floor-front wall juncture 16 along the juncture 26 and outwardly from the front wall-floor juncture 16 on the wall 24 and along the juncture 28. The portions of the apparatus 40 include wall light sources in an array 50, portions of which are located on both walls 18 and 24, and their light receptors in an array 60, portions of which are also located on both walls 18 and 24, and a corresponding floor light source array 70 and floor light receptor array 90, and portions of both of which are also located on both walls 18 and 24. The physical placement of the elements involved in the validity signal apparatus 40 are illustrated in FIG. 2.

The junctures 16, 20, 22, 26, and 28 define lines between the various adjacent perpendicular walls and floors. The wall-floor juncture 16 comprises a line boundary between the front wall 12 and the floor 14. The arrays 50, 60, and 70, 90 are disposed adjacent to the junctures 20, 26 and 22, 28, respectively, and are accordingly in perpendicular planes extending respectively upwardly and outwardly from the line boundary or juncture 16. This may be best seen from FIGS. 1 and 3A, 3B, and 3C.

Figure 2:
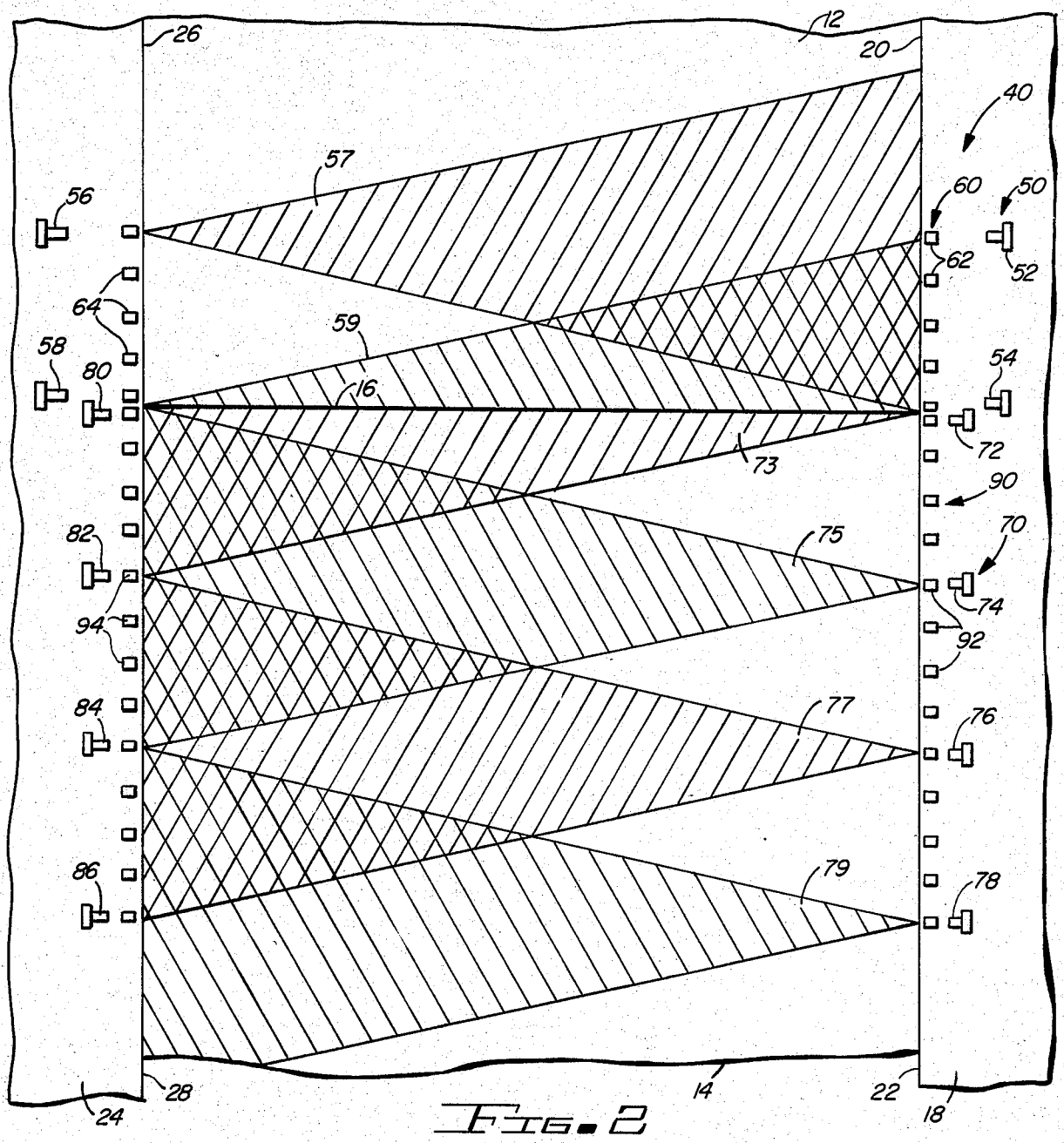
FIG. 2 is a two-dimensional representation of a portion of FIG. 1.

FIG. 2 comprises a two-dimensional representation of portions of the front wall 12, the floor 14, and the side walls 18 and 24 in the area of the front wall floor juncture 16 and along the junctures 20, 22, and 26, 28. For purposes of FIG. 2, the walls 18 and 24 have been moved outwardly, and the front wall 12 and floor 14 have been moved so that the walls, including the front wall and side walls, and the floor, are represented in a single flat, planar two-dimensional format.

Elements of the validity signal apparatus 40 are illustrated in FIGS. 1 and 2 as comprising two different types of elements, namely light source elements and light receptor elements. The light source elements are spaced apart on the walls 18 and 24, and the light receptor elements are also spaced apart on the walls 18 and 24. For simplicity in understanding or illustrating the validity signal apparatus 40, the light source elements and the light receptor elements are schematically illustrated, but only representative patterns illustrating the light originating with some of the light source elements are shown. The hatching illustrates the overlapping effect from the light source elements.

For the front wall 12, light source elements in an array 50 and light receptor elements in an array 60 are used. The light source array 50 includes a pair of light source elements 52 and 54 disposed on the side wall 18 and a pair of light source elements 56 and 58 disposed on the side wall 24. The light receptor array 60 includes a plurality of light receptor elements 62 disposed on the side wall 18 and a plurality of light receptor elements 64 disposed on the side wall 24.

It will be noted that there are more light receptor elements in the array 60 than there are light source elements in the array 50. The reason for this is that the light source elements provide a conical pattern in the light that they produce. The light source elements are spaced apart so as to provide a continuous overlapping pattern along the side walls adjacent to the front wall 12.

The light receptor elements in the array 60 are spaced apart about three-quarters of an inch so that a ball impinging on the front wall 12, upwardly from the Juncture 16 of the front wall 12 and the floor 14, and within the area covered by the validity signal apparatus 40, will interrupt the light to at least one of the receptor elements in the array 60, thus initiating a signal under the proper circumstances, as discussed later in detail.

It will be noted that the light source elements 52, 54, and 56, 58 on the walls 18 and 24, respectively, are shown spaced apart from the wall junctures 20 and 26, respectively. The actual orientation of the elements will, of course, depend on the physical size of the elements. However, they will be closer than indicated in FIG. 2, which is merely a schematic representation. In practice, the elements 52, 54 will be spaced apart about eighteen inches from each other on the wall 18 and the elements 56, 58 will also be spaced apart about eighteen inches from each other on the wall 24. However, the receptor elements 62 will be spaced apart about three-quarters of an inch from each other on the wall 18, and the receptor elements 64 will also be spaced about three-quarters of an inch apart on the wall 24. The receptor elements 62, 64 in their respective portions of the array 60 will be disposed in a vertically stacked arrangement along the wall junctures 20 and 26 and secured to the walls 18 and 24, as suggested in FIG. 1.

In FIG. 2, the light patterns emanating from the light source elements 56 and 58 are shown as comprising generally conical (triangular) patterns. The light source element 56 projects a pattern 57 and the element 58 projects a pattern 59. It will be noted that only half (the upper half) of the pattern 59 is illustrated in FIG. 2, since the element 58 is disposed adjacent to the juncture 16, and the other, bottom, half of the light originating with the light source element 58 is accordingly blocked by the floor 14. The light patterns 57 and 59 are hatched in opposite directions, thus providing a double-cross hatched pattern in the overlapping areas covered by the receptors 62.

The light source patterns emanating from the light source elements 52 and 54 are not shown in FIG. 2 for purposes of clarity.

With respect to the light sources and light receptor elements for the floor 14, a light source array 70 and a light receptor array 90 are illustrated. The light source array 70 comprises a plurality of light source elements 72, 74, 76, and 78 disposed on the wall 18 adjacent to the juncture 22 of the wall 18 and the floor 14, and a plurality of light source elements 80, 82, 84, and 86 disposed on the wall 24 adjacent to the juncture 28 of the wall 24 and the floor 14.

Pluralities of light receptor elements 92 and 94 comprise separate portions of the light receptor array 90, disposed on the walls 18 and 24, respectively. For purposes of clarity, the light patterns, in a two-dimensional representation, are shown only for the light source elements 72, 74, 76, and 78. The light patterns are hatched in opposite directions to provide a double-cross hatching effect against the wall 24 for the light receptor elements 94.

The light source element 72 projects a light pattern 73, the light source element 74 projects a light pattern 75, the light source element 76 projects a light pattern 77, and the light source element 78 projects a light pattern 79. Adjacent light patterns are oppositely hatched. The overlapping portions of the patterns 73 . . . 79 are received by the receptors 94, spaced apart from each other on the wall 24 adjacent to the juncture 28. A ball interfering with the light reception of one of the light receptors 94, under certain circumstances as discussed in detail below, will trigger a signal. As with the light source array 50 and the light receptor array 60, the light source elements in their respective array portions are spaced apart from each other about eighteen inches, and the light receptor elements are spaced apart from each other in their respective array portions about three-quarters of an inch.

It will be noted, as previously stated, that only the light patterns from half of the light source elements, those disposed on the wall 18, are illustrated in FIG. 2. However, it will be understood that similar light patterns will be transmitted from the light source elements 80, 82, 84, and 86, located on the wall 24, and will be received by the light receptor elements 92 secured to the wall 18. The light source patterns from the light source elements 80 . . . 86 have been omitted for purposes of clarity, just as the light patterns from the light source elements 52 and 54 have been omitted.

It is understood that the pattern of light produced by the light source elements is broadcast in a generally conical pattern. However, since the light source elements are located so close to the front wall 12 and the floor 14, only a portion of the total conical pattern will be effectively transmitted. In FIG. 3A and 3B, a schematic representation of the light patterns for the front wall 12 and the floor 14, respectively, is shown. The overlapping curves illustrate the overlapping effect of the light patterns. FIG. 3C is a composite showing the combined light patterns of FIGS. 3A and 3B.

In FIGS. 3A, 3B, and 3C, the front wall 12 and the floor 14 are shown. In FIG. 3A, the light patterns 57 and 59, overlapping on the wall 12, from the light source elements 56 and 58, are shown. In FIG. 3B, the light patterns 73, 75, 77, and 79 and their overlapping effect with respect to the floor 14, are shown. The light patterns 73 . . . 79 are from the light source elements 72, 74, 76, and 78, respectively, as discussed above.

In FIG. 3C, a composite effect of the light patterns 57 and 59 and the light patterns 73 . . . 79 are shown. In FIG. 3C, it will be understood that there appears to be an interference with respect to the light patterns 57 and 59 and the light patterns 73 and 75. However, the pulsing light source elements 56 and 58, which produce the light patterns 57 and 59, respectively, provide a different frequency than the pulsing light source elements 72 . . . 79, which provide the light patterns 73 . . . 79, respectively. The light receptor elements for the respective patterns on the wall 12 and the floor 14 are only sensitive to the frequency of the particular pulsed light source to which they pertain. Accordingly, there is an overlapping effect, which is desired, of the wall light patterns 57 and 59, but not an interfering pattern between the wall light receptor elements which receive the light patterns 57, 59, and the light patterns produced by the floor light source elements. Similarly, the floor light receptor elements 94 respond to only the light patterns from the light source elements 72 . . . 78, and do not provide an output signal in response to the light source elements associated with the wall 12. Thus, the light receptors for the wall and for the floor are different and respond only to the light source elements for which they are designed.

FIG. 4 is a schematic representation of a single light source element 52 and of a light pattern 53 emanating therefrom. As has been discussed above, and as shown in conjunction with FIGS. 2, 3A, 3B, and 3C, each light source element, such as the element 52, provides a conical beam or light pattern. The light pattern 53, conical in configuration, extends outwardly from the light source 52.

The light source 52, and the light sources discussed herein, are preferably infrared emitting diodes. That is, they are light emitting diodes which emit light in the infrared portion of the spectrum. The actual spacing and number of infrared emitting diodes (hereinafter abbreviated as IRED) depends on the pattern from each emitting diode or emitter. The pattern is a function of the half power angle alpha illustrated in FIG. 4.

The angle alpha in FIG. 4 represents the angular pattern for one-half of the maximum radiated power from the IRED 52. The angle alpha extends between a maximum radiated power line 51M and an outer line 51H. The line 51M comprises a line extending axially with respect to the IRED 52 and is thus the imaginary line on which the maximum radiated power from the IRED 52 extends. The line 51H defines a generally conical pattern disposed about the line 51M and it represents an imaginary conical boundary line defining the outer boundary of one-half of the maximum radiated power of the IRED 52. The angle alpha accordingly is an angle between the line 51M and the conical line 51H which represents the maximum angular width of the light pattern 53 at which the light intensity varies from maximum at 51M to one-half of the maximum at 51H.

Outwardly from the line or the conical configuration defined by the line 51H, the light intensity from the IRED 52 is less than one-half the maximum radiated power. Thus, for the overlapping light patterns, as best illustrated in FIGS. 2 and FIGS. 3A, 3B, and 3C, the light power impinging on the light receptor elements will receive a minimum of one-half the maximum radiated power from each light source IRED, for a total of at least the maximum radiated power that is provided by any one IRED light source.

The spacing of the IRED light source elements is based on the half maximum radiated power, or angle alpha, for each light source element so as to provide the overlapping effect of the total maximum radiated power on each of the light receptor elements. That is, from one wall 18 to the opposite wall 24, the overlapping alpha angles will provide the pattern illustrated in FIG. 2 so that there is a summation of the radiation to cover all areas where the light receptors or detectors will be placed on the opposite wall. Each detector or receptor accordingly will receive the equivalent light power of maximum radiated power that is provided by any one IRED light source. Knowing the half power angle alpha of the IRED light sources, the appropriate spacing between each IRED light source may be determined.

As previously indicated, the spacing between adjacent light receptor elements, or detectors, which are phototransistors, is in accordance with the size of the ball so that at least a single light receptor or detector is affected by a ball hitting the front wall or the floor 14 in the covered areas. That is, the spacing will be such as to provide that regardless of where a ball moves in covered area, the light impinging on at least a single receptor will be interrupted by the passage of the ball. The spacing between receptors accordingly will be less than the diameter of a ball, and preferably about the same as the radius of a ball, or perhaps less, to insure adequate coverage.

To insure that there no interference between the wall elements and the floor elements, the pulsing frequency of the elements may be varied or frequency and pulse width may be varied. This would make certain that, for example, a wall element does not respond to a floor element, and vice versa.

Since the wall and floor arrays are close together, there obviously may be an overlap of light between them. To preclude interference between the arrays, the wall light source elements may be pulsed at a different frequency from the frequency at which the floor light arrays are pulsed. The frequency at which the infrared light emitting diodes (IREDs) in the wall light source array 50 are pulsed may be about two times the frequency at which the infrared light emitting diodes in the floor light source array 70 may be pulsed. Thus, if the frequency of the pulsing of the light emitting diodes in the floor light source array 70 is about two kilohertz, then the frequency of the pulsing of the light emitting diodes of the wall light source array 50 is about four kilohertz. However, this is not an important relationship.

The phototransistors of the two receptor arrays 60 and 90 are tuned to the frequency of their respective light emitting diodes. Accordingly, the overlapping light from one array will not trigger an output in the other array. Similarly, the interference or blocking of a light beam by a ball in one array will not trigger an output from the other, adjacent array.

Another method, other than varying the frequency and pulse width, for assuring that interference between the wall elements and the floor elements does not occur is in the use of polarized lenses. FIG. 5 comprises a schematic representation of a polarizing lens system. A wall IRED element 56 and a polarizing lens 100 are shown adjacent to a schematic representation of an X-Y-Z axis set. A light wave pattern 102 is shown schematically emanating from the IRED element 56 and through the lens 100. The light wave pattern 102 vibrates in the X-Y plane. A wall light receptor element 62, a phototransistor, is shown spaced apart from another polarizing lens 103. The lenses 100 and 103 are matched to polarize the light in the X-Y plane, and thus allow only light waves vibrating in the X-Y plane to pass through them. Accordingly, only the light waves emanating from the IRED 56 and passing through the lenses 100 and 103 will be received by the phototransistor 62.

A floor light source IRED 80 and a polarizing lens 104 are shown spaced apart from a floor light receptor element, a phototransistor 92. Another X-Y-Z axis set is shown adjacent to the IRED 80 and the lens 104, and a light wave pattern 106, polarized by the lens 104 to vibrate in the Z-Y plane, is shown in conjunction with the X-Y-Z axis set and the IRED 80. Disposed adjacent to the phototransistor 92 is another polarizing lens element 108, which is rotated ninety degrees from the rotation of the polarizing lenses 100 and 103 to match the lens 104. It accordingly passes light vibrating only in the Z-Y plane. Thus, only the light vibrating in the Z-Y plane, or the light emanating from the IRED 80 and passing through the polarizing lens 104, will pass through the polarizing lens 108, and only that light will be received by the phototransistor 92.

Light vibrating in a plane other than the Z-Y plane will not pass through the lens 108. Similarly, any light vibrating in other than the X-Y plane will not pass through the polarizing lens 103. In this manner, the light wave 102 will not pass through the polarizing lens 108 and will thus not be received by the phototransistor 92. Neither will light, such as the light wave 106, originating from the IRED 80 and the other IREDs in its array, and vibrating in the Z-Y plane, pass through the polarizing lens 103. The phototransistor 62 accordingly will receive only the appropriately polarized light originating from its IREDs and the phototransistor 92 will receive only the appropriately polarized light originating from its IRED 80 and the other IREDs in its array. By the use of the matched polarizing lenses disposed adjacent to the IREDs and the phototransistors, light received by the phototransistors is limited to the light corresponding to their respective IREDs.

Obviously, the light emanating from the respective IREDs must be polarized appropriately to correspond with the polarizing lenses associated with the receptor phototransistors. Thus, each IRED will include a polarizing lens with the polarization axis parallel to the polarization axis of the lens associated with the respective receptors.

A schematic representation of the validity signal apparatus 40 is shown in FIG. 6, using blocks to represent different portions of the apparatus. The wall light source array 50, which has been discussed above in detail and is shown in FIG. 2 as including IREDs 52 and 54 on the wall 18 and IREDs 56 and 58 disposed on the wall 24, is shown as a block. The wall light receptor array 60 is also shown in a block in FIG. 6. As discussed above, and as best shown in FIG. 2, the wall light receptor array 60 includes a plurality of light detector elements 62 secured to the wall 18 and a plurality of light receptor or detector elements 64 secured to the wall 24. The elements 62 and 64 are, or may be, as discussed, phototransistors. While the wall light source array 50 and the wall light receptor array 60 are shown as a pair of blocks in FIG. 6, it will be understood that they actually comprise elements secured in two locations, namely half of the elements on the wall 18 and half on the wall 24 for each array.

A signal, or a plurality of signals, from the wall light receptor array 60 is transmitted to sensor circuitry 67, shown as a block in FIG. 6, by a conductor, or a plurality of conductors, 66. The sensor circuitry 67 is connected to each light receptor or detector element.

The floor light source array 70 is also shown in FIG. 6 as a block. It is spaced apart from the light receptor array 90, also shown as a block. As with respect to the wall light source array 50 and the wall light receptor array 60, the floor light source array 70 and light receptor array 90 are actually a plurality of separate elements spaced apart, partially on the wall 18 and partially on the wall 24, for both arrays. The floor light receptor array 90 is connected to its own sensor circuitry 97 by a conductor, or a plurality of conductors, 96. The floor light receptor array, like the wall light receptor array, comprises a plurality of elements, namely a plurality of phototransistors 92 on the wall 18 and 94 on the wall 24. The sensor circuitry 97 is connected to each of the phototransistors and includes appropriate circuitry for determining when the light from the light source array to the receptor array has been interrupted, as discussed above.

From the sensor circuitry 97, a conductor 98 extends to an audible signal or alarm apparatus 99 and/or to visual alarm apparatus 99A. Sensor circuitry 67 is connected to sensor circuitry 97 by a conductor 68.

A change in light intensity is noted by the receptors in an array in response to a ball interfering with the output from a light source array. When a ball goes between an IRED and its phototransistor receptors, the change in light intensity is noted by at least a single receptor, and an output is triggered in response to the change in light intensity. The change in light intensity is noted in an interruption of the pulsed output of the phototransistors in a light receptor array. Since the output of the infrared light emitting diodes is pulsed at a specific frequency, there will be an output pattern in the output of the phototransistors in the wall and floor light receptor arrays corresponding to their respective frequencies. However, if a light beam is interrupted by a ball, then the output of at least one, and probably more than one, phototransistor will be different from its usual output and from the output of the other phototransistors in the receptive wall light receptor arrays or floor light receptor arrays. A missing pulse is thus detected by the sensor circuitry involved in the present invention.

When the floor light receptor array 90 is triggered in some manner by a ball interfering with the light between the floor light source array 70 and the floor light receptor array 90, a missing pulse detector in the sensor circuitry 97 detects a change, or the missing pulse, in the floor light receptor array 90. The audible alarm 99 and/or the visual alarm 99A, indicating a fault, or a bad or illegal shot, is then triggered. However, if a similar missing pulse detector for the wall light receptor array 60 is triggered prior to the triggering of the floor light receptor array 90, then the alarm 99 or 99A is prevented from sounding. Thus, the wall 12 must be hit by a ball a predetermined time period prior to the ball hitting the floor 14.

If the floor light receptor array 90 is triggered before the wall light receptor array 60 is triggered, then the audible alarm 99 sounds for a predetermined time, such as for about two or three seconds. After the two or three seconds has expired, the circuitry automatically resets itself, ready for the next play action.

A plurality of lines with arrowheads representing the light beams from the infrared light emitting diodes comprising the wall light source array 50 are shown in FIG. 6 extending from the wall light source array 50 toward the light receptor array 60. Similarly, a plurality of lines representing the light output from the infrared light emitting diodes of the floor light source array 70 are shown extending between a block representing the floor light source array 70 and a block representing the floor light receptor array 90. The power and signal sources for the arrays are not shown, but are well known and understood in the art.

If there is an interference of the light between the floor light source array 70 and the floor light receptor array 90, as from a ball, there is an interference between the output signal on conductor 96 between the light source receptor array 90 and its sensor circuitry 97. From the sensor circuitry 97, the conductor 98 extends to the audible alarm element 99. The audible alarm 99 will sound for a predetermined amount of time, such as for two or three seconds, unless a blocking signal is received from the wall light receptor array 60 within a predetermined time period prior to the detected missing floor pulse.

If a ball interrupts or interferes with the light between the wall light source array 50 and its wall light receptor array 60, the interference is detected by the sensor circuitry 67. The sensor circuitry 67, like the sensor circuitry 97, includes a missing pulse detector which, as discussed above, detects a change in the pulses of the infrared light emitting diodes from the respective light source arrays. When the sensor circuitry 67 detects a change in the output of the wall light receptor array 50, an output signal is transmitted from the sensor circuitry 67 by a conductor 68 to the sensor circuitry 97 for the floor light receptor array 90.

The output signal on the conductor 68 is in effect a blocking signal which blocks the output signal from the sensor circuitry 97 on conductor 98 to the alarm 99. The ball must interrupt the light beams or the light pattern for the wall arrays before the ball also interrupts the light pattern of the floor array in order to prevent the alarm 99 from sounding. Accordingly, there is a timing out period which must be determined in order to prevent the alarm from sounding, thus indicating that the shot is a good shot. In order for the shot to be determined as a good shot, the front wall must be hit before the floor is hit. Or, in other words, the floor must be hit within the predetermined timing out period after the front wall is hit.

In place of the IRED arrays disposed on the walls and on the floor, two laser emitters may be used to replace the arrays of IREDs. One laser emitter may be used to create the sensing field on the wall and the other laser emitter may be used to create the sensing field for the floor. An advantage of using laser light is that it will not require special techniques for isolating the two planes as in the above-discussed IRED systems. Moreover, by using mirror panels, only a single detector is required in each plane. A mirror array is arranged to reflect the laser beam across the wall and across the floor at approximately the same spacing interval, namely three-quarters of an inch, as discussed above with respect to the spacing of the phototransistor light receptors. Only two detector circuits, one for the wall and one for the floor, are required. The laser system is schematically illustrated in FIG. 7.

FIG. 7 comprises a schematic representation of a laser and mirror system 110 which includes a single wall laser emitter 112 disposed on a wall and emitting a beam of light towards a mirror array 114 secured to the opposite wall. In FIG. 7, the wall laser emitter 112 is schematically illustrated as being secured to the wall 24 adjacent to the wall juncture 26. The wall mirror array 114 is schematically illustrated as secured to the wall 18 adjacent to the wall juncture 20. The mirror array 114 comprises a plurality of adjacent mirrors disposed at 90° to each other such that light impinging on one mirror panel is reflected to the next adjacent mirror panel, and from the adjacent mirror panel the light beam is reflected across the court to another, opposite mirror panel array 116. The mirror array 116 is secured to the wall 24 adjacent to the juncture 26 in a substantially identical arrangement to the mirror array 114. The array 116 includes a plurality of mirror elements secured to each other at adjacent 90° orientations, with a light beam impinging on one mirror and reflected to an adjacent mirror, back across the court, and thus back and forth between the mirror arrays 114 and 116 on opposite walls 18 and 24, respectively.

From the uppermost mirror panel on the array 114, the light beam extends to a wall light detector 120. From the wall light detector 120 an appropriate signal is transmitted on a conductor 122 to sensor circuitry 124. From the sensor circuitry 124, a conductor 126 extends to sensor circuitry 144.

The laser light system 110 also includes a floor system which is substantially identical to the wall system. It includes a floor laser emitter 132 which provides a beam of light transmitted from the emitter 132 across the court to a floor mirror array 134. The floor mirror array 134 comprises a plurality of mirror elements disposed along the floor-wall juncture 22 and secured to the wall 18. The panels or mirror elements in the array 134 are oriented at 90° to each other and the light reflected between a pair of adjacent elements is reflected back across the court and above the floor 14 to a similar, substantially parallel mirror array 136.

The mirror array 136 comprises a plurality of mirror elements disposed at 90° to each other, substantially identical to the array 134 and to the arrays 114 and 116. The mirror arrays 134 and 136 thus cooperate for the floor 14 in substantially the same manner as do the mirror arrays 114 and 116 for the front wall 12 to reflect a light back and forth. The light thus reflected ultimately impinges upon a floor light detector 140.

From the floor light detector 140, a conductor 142 extends to appropriate sensor circuitry 144. The sensor circuitry 144 is connected by a conductor 146 to an audible signal element 148. The sensor circuitry 144 includes the appropriate logic necessary to determine when the audible alarm 148 should be sounded. A visual alarm may be included, if desired.

As discussed above in conjunction with the validity signal apparatus 40 of FIGS. 1–6, the parallel light beams reflected from the mirror arrays for both the wall and the floor provide coverage about every three-quarters of an inch. This insures that a ball entering into the area will interrupt the light beam at least once to insure that an appropriate signal is provided for the sensor circuitrys 124 and 144 to operate on.

If the light beam to the floor light detector 140 is interrupted before the beam of light to the wall light detector 120 is interrupted, or if the wall light detector is not interrupted, the audible signal element 148 will be sounded to indicate the invalidity of a particular shot. However, if the beam of light to the wall light detector 120 is interrupted before the beam of light to the floor light detector 140, then the audible alarm 148 will not be sounded, thus indicating the validity of the particular shot.

As in the embodiment of FIGS. 2–6, a missing (interrupted) light pulse signal from the wall sensor circuitry 124 acts as a blocking signal for a predetermined time period to the sensor circuitry 144 to prevent an output signal from the alarm element 148. There is also a predetermined timing out period for the blocking signal from the sensor circuitry 124, just as with the IRED system 40. The light interrupt signal from the floor sensing circuitry 144 must come within the timing out period in order to be blocked. A floor interrupt signal coming outside of the timing out period results in the audible alarm sounding an invalid shot. The audible alarm sounds for a predetermined time period, such as for two or three seconds, and then the system resets itself, ready for play to continue.

Conceptually, the same laser system illustrated in FIG. 7 may be applied to a tennis court. This is illustrated in FIGS. 8 and 9. In FIGS. 8 and 9, a boundary validity signal or alarm system 200 is illustrated. The boundary validity signal system 200 includes a plurality of separate systems, each of which is responsible for a single boundary, or portion of a boundary. FIG. 8 comprises a plan view of a tennis court with the various boundaries illustrated, and with a plurality of systems shown. FIG. 9 is an enlarged schematic representation of a single system shown disposed adjacent to a boundary line.

Referring to FIG. 8, a tennis court 202 is outlined. The tennis court includes four side lines, including a side line 204 and a side line 206 spaced apart from each other. The side line 206 defines a side boundary of a tennis court for singles playing, and the side line or boundary 204 defines a side boundary for a doubles tennis court. Similarly, a pair of boundary lines 208 and 210 are shown on the opposite side of the tennis court from the boundary lines 204 and 206. The boundary line 208 is a side line for a doubles court and the side line 210 is a side line for a singles court. The side lines 206 and 210 are also service court boundaries during service.

The tennis court 202 also includes a pair of base lines 212 and 214. The base lines 212 and 214 are substantially parallel to each other and perpendicular to the side lines 204, 206, 208, and 210.

The middle of the tennis court 202 is defined by a line 216. The line 216 represents a net which divides the tennis court into two portions.

For service purposes, there are two service lines 218 and 220 which extend between the side lines 206 and 210. The lines 218 and 220 are on opposite sides of, and parallel to, the middle line or net 216. Center service lines 222 and 224 extend between and bisect the service lines 218 and 220, respectively, from the net 216.

As is well known and understood, the widths of the various boundary and service lines are typically about two inches. A ball landing on a line is considered as "in" and is therefore a good ball. A ball landing outside of a line is "out" and therefore, using the present system, causes an audible or visual alarm to ring or sound or to display the fault.

As shown in FIG. 8, there are eight outer boundary alarm systems, including a pair of boundary alarm systems 230 and 250 which are located adjacent to the side doubles boundary 204, a pair of boundary alarm systems 270 and 290 which are located adjacent to the opposite doubles boundary or side line 208, two pair of singles side line and service side line boundary systems 470, 490 and 510, 530 for the boundary lines 206 and 210, respectively, and a pair of base line boundary systems 310 and 330, adjacent to the base lines 212 and 214, respectively. The side line boundary systems are doubled for each boundary line due to the presence of the net 216.

The base line boundary systems 310 and 330 may be fixed in place since the base lines 212 and 214 are constant. However, the side line systems 230, 250 and 270, 290 for the side lines 204 and 208 may be movable, if desired, to eliminate or take the place of the systems 470,490 and 510, 530 for singles play. For playing singles, the side lines 206 and 210 are used, and for playing doubles the side lines 204 and 208 are used. Accordingly, the side line boundary systems 230, 250 and 270, 290 may be movable to cover the side lines 204, 206 and 208, 210, respectively. However, even during doubles play the side lines 206 and 210 must be covered during service. In the alternative, the side line boundary systems 230, 250 and 270, 290 may also be fixed in place, with the auxiliary systems 470, 490 and 510, 530 utilized when singles are being played and for service for covering the single and service side lines 206 and 210. Another alternative is to have the systems 230, 250 and 270, 290 fixed in place and utilize a mirror system to cover the singles and service side lines. This is disclosed below in FIG. 10 and is discussed in conjunction therewith.

The boundaries being monitored on the tennis court also comprise or define lines on the outer edges or sides of the marked boundary lines since the marked boundary lines have finite widths.

During a tennis match, the outer boundary systems, including the side line systems 230, 250 and 270, 290 for doubles, or 470, 490 and 510, 530 for singles, and the base line systems 310, 330 are in use constantly since, for any particular game, the outer boundaries remain constant at all times. However, the service lines 218,220 and 222,224 are only of concern during service. The service boundary systems include systems 390 and 410 which cover opposite sides of the center service line 222, and boundary systems 430 and 450 which cover opposite sides of the center service line 224. Accordingly, while six service systems are illustrated in FIG. 8 for the service lines 218, 220, 222, and 224, they are only utilized or activated during service. Upon the completion of a serve, the systems are inactivated. Four additional service systems are needed to cover the side lines 206 and 210 during the serves. As is well known and understood, during doubles play, the side lines 206 and 210 are boundary lines for the service courts during service. Accordingly, the additional pairs of service boundary systems 470, 490 and 510, 530 are required to cover the service boundaries 206 and 210 during service for doubles and also during play (volleying) for singles.

During singles play, the boundary systems used for the side lines 206 and 210 are operative during service as well as during regular play, and the service systems 230, 250 and 270, 290 are not required. During doubles play, when the side lines 206 and 210 are used as service boundaries, then the additional service systems 470, 490 and 510, 530 are required during service in addition to the side line boundary systems 230, 250 and 270, 290 for the side lines 204 and 208, respectively. It will be noted that the boundary systems are on the "out" side of their respective boundaries.

FIG. 9 is a schematic representation of the boundary system 250 for one-half of the side line 204. A portion of the side line 204 is illustrated, and the boundary system 250 is disposed adjacent to, but on the outside of, the side line 204. The boundary system 250 includes a laser emitter 252, which may be substantially identical to the laser emitters discussed in conjunction with FIG. 7.

The emitter 252 is aimed toward an end panel of a mirror array 254. The array 254 is disposed adjacent to the net 216 (see FIG. 8). The mirror array 254 is in turn disposed oppositely from and aligned with a second mirror array 256. The mirror arrays 254 and 256 each include a plurality of mirrors disposed at substantially ninety degrees from each other and are in general parallel alignment with the mirrors of the opposite array, disposed so that the light beam from the emitter 252 impinges upon a mirror panel in the array 254, is reflected to an adjacent panel in the array 254 and reflected to a panel in the array 256, etc.

Preferably, the mirror arrays 254 and 256 extend outwardly from adjacent to the boundary 204 to about six to ten inches away from the outer edge of the boundary line 204. This gives sufficient coverage to allow a ball falling outside the boundary 204 to be detected. The light beam is ultimately reflected from the last panel in the array 254 to a detector 260.

From the detector 260, a signal is transmitted to timing and logic circuitry contained in a block 264. The presence of a ball breaking the light beam between the mirror arrays 254 and 256 results, according to the timing and logic circuitry 264, in an output signal from a fault enunciator 268, which may include an audible alarm which sounds for two to three seconds.

All of the boundary systems, including the service systems, may be substantially identical to the system 250 illustrated in FIG. 9. Obviously, the elements of the systems 230 . . . 530 are placed well back from the court 202 so as not to interfere with the players and their movements on the court and adjacent to the court as play continues. The illustration of the apparatus as included in FIG. 8, in FIG. 9, and also in FIG. 10, is for illustrative purposes, and actual dimensions, relative sizes, etc., are not indicated or alluded to.

Each of the boundary systems, including the base line boundary systems, the side line boundary systems, and the service line boundary systems, comprise fault detection systems which monitor all of the lines and which provide a signal for balls which initially hit beyond the boundary lines. As indicated above the systems monitoring the service fault lines, namely the lines 218, 220, 222, 224, and 206 and 210 during the doubles play, are turned on, as by a line judge, for service only. At the conclusion of service, they are turned off for subsequent play. In the case of singles games, the service side lines 206 and 210 also comprise side line boundary lines for play, and thus the boundary monitor systems for those lines will be "on" at all times. However, for ordinary service, the boundary monitor systems 350, 370, 390, 410, 430, and 450 are "on" only during service. They are turned off after service so as to not provide a signal other than at the occurrence of a fault during service. However, if desired, the service detection system may stay on, but the audible system connected to it may be turned on/off for each serve.

The laser emitters, mirror systems, and laser detectors initially detect an interruption of the laser field when a ball impinges outside of the boundary line and in the area covered by or monitored by, the laser beam signal. If the laser field is interrupted and then re-established within a predetermined time period, a fault is enunciated. The interruption of the field and the re-establishment of the field within a predetermined period of time indicates that a ball has hit in the court area covered by a monitor and has bounced off the court. This indicates that the ball hit into an out-of-bounds area and the shot resulting in the particular interruption of the field is a bad shot, according to the timing and logic circuitry.

If the field covered by the laser system is interrupted for a time period longer than the originally predetermined time period, no fault is enunciated. Thus, if a player's foot breaks a beam of light between a pair of mirror arrays, the light beam will be interrupted for a time period longer than one in which a ball hits into the area and then bounces away again. Obviously, the movement of a foot, even relatively fast, as a step into the field and immediately out of the field, is not as fast as a bouncing ball. Accordingly, no fault is detected for a relatively long interruption of the field. For a relatively short interruption of the field, a bouncing ball is the most logical explanation and the apparatus therefore detects a fault and such fault is enunciated through the fault enunciator 268, shown in FIG. 9. Thus, the purpose of the timing limit is to distinguish between a player breaking the beam and the ball breaking the beam.

For converting a doubles sideline boundary system into a sideline boundary system for singles play, or for utilizing the doubles sideline boundary system as a sideline service boundary system for the service boundaries 206 and 210, thus eliminating half of the systems required for the sidelines, a system 600 such as shown in FIG. 10 may be used. FIG. 10 comprises a schematic representation of the sideline 204 and the singles sideline 206. The boundary system 250 is shown disposed adjacent to, and outside, the sideline 204. In conjunction with the boundary system 250, a mirror 602 is shown disposed between the emitter 252 and the mirror array 256. The mirror 602 is disposed at a forty-five degree angle with respect to the light beam emanating from the emitter 252. The light beam accordingly is reflected from the mirror 602 to another mirror 604 which is substantially parallel to the mirror 602. The mirror 604 is disposed adjacent to the outside of the service line or singles sideline 206. The mirror 604 is in turn used to reflect the light beam substantially parallel to the boundary 206 and to a mirror array 606.

The mirror array 606 comprises a plurality of mirrors disposed at substantially ninety degrees to each other to reflect the light beam from one adjacent mirror panel to the adjacent mirror panel and down along the boundary line again to a second mirror array 608. The mirror array 608 is substantially parallel to the mirror array 606 and is used for substantially the identical purpose of reflecting the light beam back and forth to cover the six or so inch area immediately outside of the boundary line 206.

Finally, the light beam reflecting from the last panel in the array 606 is directed toward a light detector 610. The detector 610 is connected to timing and logic circuitry 614. The timing and logic circuitry 614 is in turn connected to fault enunciator 620.

The operation of the detector 610, the timing and logic circuitry 614, and the fault enunciator 620 is substantially as discussed above in conjunction with the corresponding elements of the boundary system 250 illustrated in FIG. 9.

If the mirror 602 is a partial mirror, or beam splitter, a portion of the light beam from the laser emitter 252 passes through the mirror 602 and accordingly extends to the mirror array 254, from where it is reflected to the mirror array 256, etc., as discussed above. At the same time, a portion of the light beam from the emitter 252 is reflected from the mirror or beam splitter 602 to the mirror 604. Thus, about half of the light is usable by the boundary system 250 and the other half may be used by the boundary system 600 of FIG. 10.

The utilization of the beam splitter 602 allows the same emitter 252 to be used for a dual purpose, namely to operate full time in conjunction with the sideline 204 as a fault enunciator for the sideline boundary 204, and to be used in conjunction with the service boundary 206 during service. At such time as service is completed, the system 600 may be disabled or turned off remotely to prevent its actuation during normal doubles play, or it may operate full time during singles play.

As opposed to using a partial mirror or beam splitter 602, the mirror 602 may be pivotable into and out of its position shown in FIG. 10 by well known and understood elements, not shown. Thus, the mirror 602 would be a whole mirror which, in the position shown in FIG. 10, reflects a totality of the light beam from the emitter 252 towards the mirror 604. The entire light output of the emitter 252 is thus usable in the system 600 for singles play and doubles service. For doubles play, the mirror 602 is in the position shown in FIG. 10 only during service. At the conclusion of each service, the mirror 602 may be pivoted out of the way to allow the entire light output from the emitter 252 to be used with the boundary system 250 to monitor the sideline 204.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Validity signal apparatus for monitoring a line boundary of a playing court to determine the validity of an occurrence at the line boundary being monitored, comprising, in combination:

first light source means for providing light in a first plane substantially perpendicular to the line boundary at the line boundary being monitored;

first light receptor means for receiving the light provided by the first light source means and for providing a first signal in response to the light received; and second light source means for providing light in a second plane substantially perpendicular to the first plane at the line boundary being monitored;

second light receptor means for receiving the light provided by the second light source means and for providing a second signal in response to the light received;

timing and logic means for receiving the first and second signals, including first detector means for detecting the interruption of the signal from the first light receptor means in response to the interruption of the light between the first light source means and the first light receptor means and for providing a blocking signal in response thereto, second detector means for detecting the interruption of the signal from the second light receptor means in response to the interruption of the light between the second light source means and the second light receptor means and for providing an output signal in response thereto, and timing means for receiving the output signal from the second detector means and for receiving the blocking signal from the first detector means and for providing a signal in response to the output signal from the first detector means unless the blocking signal is received within a predetermined time period prior to receiving the signal from the second detector means.

2. The apparatus of claim 1 in which the first light source means comprises a plurality of light sources spaced apart from each other in the first plane, and the first light receptor means comprises a plurality of light receptors spaced apart from each other in the first plane for receiving the light from the plurality of light sources.

3. The apparatus of claim 2 in which the second light source means comprises a plurality of light sources spaced apart from each other in the second plane, and the second light receptor means comprises a plurality of light receptors spaced apart from each other in the second plane for receiving the light from the plurality of light sources of the second light source means.

4. The apparatus of claim 3 in which a first portion of the plurality of first light sources and a first portion of the first light receptors are disposed on one side of the court in the first plane, and a second portion of the plurality of first light sources and a second portion of the first light receptors are disposed on the other side of the court from the first portions in the first plane.

5. The apparatus of claim 4 in which a first portion of the plurality of second light sources and a first portion of the plurality of second light receptors are disposed on one side of the court in the second plane, and a second portion of the plurality of second light sources and a second portion of the plurality of second light receptors are disposed on the other side of the court from the first portions in the second plane.

6. The apparatus of claim 1 in which the first light source means comprises a first laser light source and a plurality of mirrors disposed on opposite sides of the court and aligned with each other for reflecting the light from the first laser light source back and forth across the court in the first plane.

7. The apparatus of claim 6 in which the first light receptor means comprises means for receiving the reflected laser light from the first light source means.

8. The apparatus of claim 7 in which the second light source means comprises a second laser light source and a plurality of mirrors disposed on opposite sides of the court and aligned with each other for reflecting the light from the second laser light source back and forth across the court in the second plane.

9. The apparatus of claim 8 in which the second light receptor means comprises means for receiving the reflected laser light from the second light source means.

* * * * *